United States Patent [19]

Nozaki

[11] 4,317,974

[45] Mar. 2, 1982

[54] SWITCH PROTECTING AND ADJUSTING ARRANGEMENT

[75] Inventor: Akira Nozaki, Toda, Japan

[73] Assignee: Clarion Co., Ltd., Tokyo, Japan

[21] Appl. No.: 127,273

[22] Filed: Mar. 5, 1980

[30] Foreign Application Priority Data

Mar. 19, 1979 [JP] Japan ..... 54/35192[U]

[51] Int. Cl.[3] ..... H01H 3/60

[52] U.S. Cl. ..... 200/330; 200/153 V; 200/340; 200/335

[58] Field of Search ..... 200/329, 330, 331, 332, 200/335, 340, 153 V, 153 T, 292

[56] References Cited

U.S. PATENT DOCUMENTS

| | | | |
|---|---|---|---|
| 1,282,548 | 10/1918 | De Reamer | 200/331 |
| 1,924,351 | 8/1933 | Doddridge | 200/330 |
| 3,075,396 | 1/1963 | Smith | 200/330 |
| 3,180,964 | 4/1965 | Farnsworth | 200/330 |
| 3,673,365 | 6/1972 | Schadow | 200/153 V |
| 3,961,146 | 6/1976 | Dummer | 200/153 V |

*Primary Examiner*—John W. Shepperd

*Attorney, Agent, or Firm*—Blanchard, Flynn, Thiel, Boutell & Tanis

[57] ABSTRACT

A switch protecting and adjusting arrangement for a switch operating mechanism, wherein a movable member is connected to one end of an operating lever, a slide member is provided on the movable member through a spring so as to be displaceable thereon, and a switch knob is held between the movable member and the slide member.

4 Claims, 6 Drawing Figures

SWITCH PROTECTING AND ADJUSTING ARRANGEMENT

BACKGROUND OF THE INVENTION

1. Technical Field

This invention relates to a switch protecting and adjusting arrangement for use in a switch operating mechanism which is capable of preventing possible peeling of a circuit pattern from a printed board or breakage of a switch attached to the printed board.

2. Description of Prior Art

Where a slide switch is attached to a printed board and subjected to a remote control for operation thereof, an excessive force is liable to be applied to a circuit pattern of the printed board or the switch. Therefore, a conventional switch operating mechanism has been suffering from such a problem that the pattern is possibly peeled and the switch is possibly broken due to the excessive force applied to the circuit pattern or the switch. Furthermore, where a metal sheet with a switch operating slot punched out therefrom is employed as a switch operating member, there have been disadvantages; for example, as many sheets must be prepared as there are kinds of configurations of switch knobs so as to adapt to the configurations of the switch knobs, and a switch resetting mechanism having a spring means cannot be provided.

OBJECT OF THE INVENTION

Accordingly, it is an object of the present invention to provide a switch protecting and adjusting arrangement for a switch operating mechanism which is capable of preventing possible peeling of a circuit pattern or possible breakage of a switch on a printed board.

SUMMARY OF THE INVENTION

In accordance with the present invention, there is provided a switch protecting and adjusting arrangement which comprises:

an operating lever;

a movable member connected to one end portion of said operating lever;

a slide member provided on said movable member so as to be displaceable relative thereto;

a spring connecting said movable member to said slide member;

a switch knob held between said movable member and said slide member; and a switch adapted to be closed and opened upon displacement of said switch knob.

DESCRIPTION OF THE PREFERRED EMBODIMENT

Figure 1:
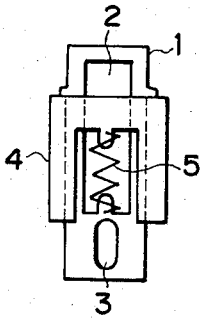
FIG. 1 is an elevational view of one form of switch protecting and adjusting arrangement in accordance with the present invention.
Figure 2:
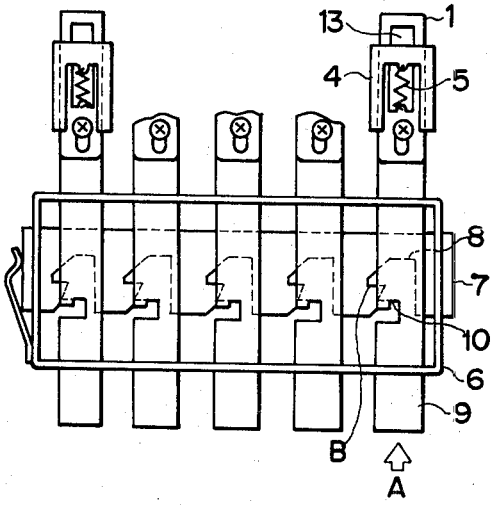
FIG. 2 is a view showing an application example of the arrangement illustrated in FIG. 1.
Figure 3:
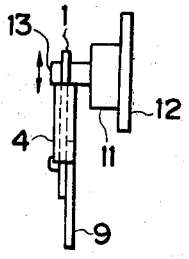
FIG. 3 is a side elevational view of a main part of the arrangement illustrated in FIG. 1.

Referring now to FIGS. 1 to 3, there is illustrated one preferred embodiment of the invention. A movable member 1 has an opening 2 for disposing a spring 5 therein and an adjusting elongated slot 3. A slide member 4 formed in substantially ]—shape is disposed over the movable member 1 so as to slide thereon and connected to the movable member 1 by the spring 5. Numeral 6 designates a switch operating case and numeral 7 designates a slide bar disposed laterally within the case 6 and formed with a stopper 8. An operating lever 9 has a projection 10 adapted to engage with and disengage from the slide bar 7 within the case 6. An inner end of the operating lever 9 is adjustably connected to the movable member 1 through the opening 3. Numeral 11 designates a slide switch, 12 a printed board, and 13 a switch knob.

The operation of the arrangement in accordance with the present invention will now be described. Upon depression of the operating lever 9 in a direction of arrow A, a switch condition is changed over, e.g., the switch 11 is closed, at B. When the operating lever 9 is further depressed, the projection 10 of the lever 9 is moved to the stopper 8 of the slide bar 7. At this time, the movable member 1 is displaced while the spring 5 provided between the movable member 1 and the slide member 4 is thereby compressed. Therefore, an excessive force can be well prevented from being applied to a circuit pattern on the printed board 12 or to the slide switch 11.

Figure 4:
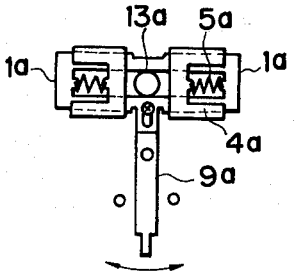
FIGS. 4 to 6 are elevational views of other forms of switch protecting and adjusting arrangement in accordance with the present invention.

FIG. 4 illustrates a second embodiment of the present invention wherein a slide switch is disposed laterally. An operating lever **9*a* is adapted to pivot or tilt when actuated. Upon actuation of the operating lever 9*a*, a movable member 1*a* is displaced in a lateral direction together with a pair of slide members 4*a* connected to the movable member 1*a* through a pair of springs 5*a*, respectively, to operate a switch knob 13*a***.

Figure 5:
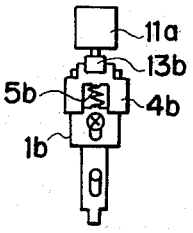

FIG. 5 illustrates a third embodiment of the present invention wherein an arrangement of the invention is applied to a push switch 11. **1*b* is a movable member, 4*b* is a slide member, 5*b* is a spring, and 13*b*** is a switch knob.

Figure 6:
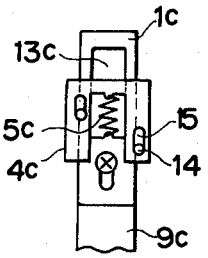

FIG. 6 is a fourth embodiment of the invention wherein slots 15 are formed on a slide member **4*c* and pins 14 are received in the slots 15 respectively. 1*c* is a movable member, 5*c* a spring, 9*c* an operating lever, and 13*c*** is a switch knob.

In accordance with the invention as mentioned above, peeling of the pattern of the printed board and breakage of the switch can effectively be prevented. Furthermore, since the switch knob is held between the movable member and the slide member, it becomes unnecessary to prepare switch operating members each adapted for respective switch knob configurations. Thus, the cost of the manufacturing of the switch operating member can be reduced. Moreover, a switch resetting mechanism having a spring can be provided.

I claim:

1. In an apparatus having a printed circuit board and a switch mounted on said printed circuit board and having a switch knob, the improvement comprising:

an operating lever adjacent said printed circuit board;

a movable member substantially parallel to and spaced from said printed circuit board near said switch and connected by adjustable means to said operating lever, said movable member having parallel side edges extending longitudinally thereof and a closed perimeter through-hole spaced between said parallel side edges and extending therealong;

a slide member slidable longitudinally on said movable member, said slide member being U-shaped in plan with a bight portion extending transversely across said hole beyond said side edges of said movable member and with a pair of legs extending in parallel from opposite ends of said bight portion in slidable relation along and overlapping the side edges of said movable member, said movable member having projections in the path of said slide member preventing said slide member from covering a knob-receiving portion of said hole, spaced apart tabs fixed to and extending toward each other from (1) said bight portion of said slide member between said legs and (2) said movable member at an end of said hole remote from said knob-receiving portion of said hole;

a spring spaced loosely between said legs of said slide member, said spring being enclosed in said hole laterally between said side edges of said movable member and extending from said bight portion of said slide member to said end of said hole, said spring being a compression spring having only its ends sleeved over respective ones of said tabs for urging said slide member against said projections on said movable member, said switch knob being receivable in said knob-receiving portion of said hole and snugly disposed between said side edges of said movable member and against said bight portion of said slide member.

2. The apparatus of claim 1, in which said operating lever extends longitudinally from the end of said movable member remote from said knob-receiving opening and is fixed thereto by said adjustable means, said operating lever being adapted to move longitudinally as a unit with said movable member, said operating lever having a projection;

a switch operating case beyond which said movable member and slide member, on the one hand, and the opposite end of said operating lever, on the other hand, protrude;

a slide bar disposed laterally within said switch operating case and extending transversely past said operating lever, said slide bar including a notch in one longitudinal edge thereof over which the portion of said operating lever carrying said projection is disposed for engagement with and disengagement from said slide bar, said notch in said slide bar having an inner end defining a stopper, said slide bar being located along the path of said operating lever such that when said operating lever is advanced sufficiently, said switch is actuated and when said operating lever is further advanced the projection thereon moves into engagement with said stopper of said slide bar, said last-mentioned movement resulting in compression of said spring and corresponding displacement of the remote end of said movable member away from said switch knob and said bight of said slide member.

3. The apparatus of claim 1, in which said movable member and said hole therein extend transversely of the length direction of said operating lever, a pair of said slide members being carried on said movable member with the bight portions of said slide members being spaced apart by a central portion of said through-hole of a size sufficient to receive therein said switch knob and defining said knob-receiving portion of said hole, the legs of said slide members and springs extending from the bight portions in a direction away from each other, said operating lever being pivoted intermediate the ends thereof, with the free end of said operating lever being pivotable to shift said movable member in opposite directions to engage the bight portions of said slide members alternatively with opposite sides of said switch knob.

4. The apparatus of claim 1, in which said projections are pins fixed on said movable member and protruding through longitudinal slots in the legs of said slide member for permitting longitudinal limited sliding movement of said slide member on said movable member in a direction for compressing said spring.

* * * * *